US005658865A

United States Patent [19]

Yoshida et al.

[11] Patent Number: 5,658,865

[45] Date of Patent: Aug. 19, 1997

[54] OXIDATION-INHIBITIVE LUBRICATING OIL COMPOSITION

[75] Inventors: Toshio Yoshida; Jinichi Igarashi; Yoko Matsuyama, all of Yokohama, Japan

[73] Assignee: Nippon Oil Co., Ltd., Tokyo, Japan

[21] Appl. No.: 568,099

[22] Filed: Dec. 6, 1995

[30] Foreign Application Priority Data

Dec. 7, 1994 [JP] Japan ..... 6-330532

[51] Int. Cl.[6] ..... C10M 129/70

[52] U.S. Cl. ..... 508/501; 508/591

[58] Field of Search ..... 252/56 R; 508/501, 508/591

[56] References Cited

U.S. PATENT DOCUMENTS

| | | | |
|---|---|---|---|
| 3,116,305 | 12/1963 | Morris et al. | 260/410.5 |
| 3,285,855 | 11/1966 | Dexter et al. | 508/501 |
| 3,364,250 | 1/1968 | Dexter et al. | 508/501 |
| 3,801,540 | 4/1974 | Dexter et al. | 252/56 R |
| 3,810,869 | 5/1974 | Zaweski | 252/56 R |
| 3,830,828 | 8/1974 | Eggensperger et al. | 252/56 R |
| 3,839,278 | 10/1974 | Dexter et al. | 252/56 R |
| 4,036,773 | 7/1977 | Okorodudu | 252/56 R |
| 4,098,708 | 7/1978 | Stuebe | 252/56 R |
| 4,954,275 | 9/1990 | Rosenberger et al. | 508/501 |
| 5,019,286 | 5/1991 | Shaw et al. | 252/56 R |
| 5,091,099 | 2/1992 | Evans et al. | 252/56 R |
| 5,354,486 | 10/1994 | Evans | 508/501 |
| 5,453,210 | 9/1995 | Bardasz et al. | 252/56 R |
| 5,460,741 | 10/1995 | Hata et al. | 252/56 R |
| 5,523,007 | 6/1996 | Kristen et al. | 508/501 |

FOREIGN PATENT DOCUMENTS

| | | |
|---|---|---|
| A3 - 0 346 283 | 12/1989 | European Pat. Off. . |
| A1 - 0 366 040 | 5/1990 | European Pat. Off. . |
| 448238 | 9/1991 | European Pat. Off. . |
| 312394 | 12/1988 | Japan . |
| 1-188592 | 7/1989 | Japan . |
| 2 028 866 | 3/1980 | United Kingdom . |

OTHER PUBLICATIONS

Smalheer et al, "Lubricant Additives", Chapter I—Chemistry of Additives, pp. 1–11, 1967.

*Primary Examiner*—Ellen M. McAvoy

*Attorney, Agent, or Firm*—Panitch Schwarze Jacobs & Nadel, P.C.

[57] ABSTRACT

A lubricating oil composition which comprises one or more base oils of the group consisting of (A) a mineral oil having a kinematic viscosity of 5–200 $m^2/s$ at 40° C. and an aromatics content of less than 15 percent by weight, (B) an olefinic polymer of 2–16 carbon atoms or its hydride having a number-average molecular weight of 250–4,000, and (C) an alkylbenzene having 1–4 alkyl groups of 1–40 carbon atoms and a total carbon number of said alkyl groups in the range of 6–40, said base oil or oils being blended with a 3-methyl-5-tert-butyl-4-hydroxyphenyl-substituted fatty acid ester in an amount of 0.1–5.0 percent by weight based on total composition. The inventive lubricant composition having such a base oil in combination with the specified fatty acid ester provides a synergistic effect conducive to inhibition or prevention of both oxidation and sludge formation while in use under elevated temperature conditions over extended periods of time.

10 Claims, No Drawings

OXIDATION-INHIBITIVE LUBRICATING OIL COMPOSITION

BACKGROUND OF THE INVENTION

1. Field of the Invention

This invention relates generally to lubricating oil compositions and specifically to such an oil composition which has high oxidative-stability at elevated temperatures.

2. Prior Art

It is widely accepted that a 2,6-di-tert-butyl-p-cresol, a compound known as DBPC, is highly effective as an oxidation inhibitor for lubricating oils such as typically turbine oil. However, DBPC per se of a relatively low molecular weight is vulnerable to evaporation upon exposure to elevated temperature over prolonged length of time resulting in a loss of oxidative-stability of a turbine oil.

Japanese Laid-Open Patent Publication No. 60-156644 discloses the use of sterically hindered hydroxyphenylcarboxylic acid ester as a stabilizing agent for synthetic organic polymers, animal and vegetable oils, hydrocarbons, lubricants and the like. A specific example of this stabilizing agent is disclosed to be (3,5-di-tert-butyl-4-hydroxyphenyl) propionic acid ester. While this compound is much more resistant to diminution by evaporation compared to the 2,6-di-tert-butyl-p-cresol, it is less effective in terms of oxidation-inhibition.

SUMMARY OF THE INVENTION

With the foregoing drawbacks of the prior art, the present invention seeks to provide a lubricating oil composition which essentially comprises a base oil having a peculiar property and/or a peculiar structure combined with a selected amount of a specified class of fatty acid esters to provide a synergistic effect conducive to inhibition or prevention of both oxidation and sludge formation while in use under elevated temperature conditions over extended periods of time.

More specifically, the invention provides a lubricating oil composition which comprises one or more base oils of the group consisting of (A) a mineral oil having a kinematic viscosity of 5–200 $m^2/s$ at 40° C. and an aromatics content of less than 15 percent by weight, (B) an olefinic polymer of 2–16 carbon atoms or its hydrogenated product having a number-average molecular weight of 250–4,000, and (C) an alkylbenzene having 1–4 alkyl groups of 1–40 carbon atoms and a total carbon number of said alkyl groups in the range of 6–40, said base oil or oils being blended with a 3-methyl-5-tert-butyl-4-hydroxyphenyl-substituted fatty acid ester in an amount of 0.1–5.0 percent by weight based on total composition, said fatty acid ester being represented by the formula

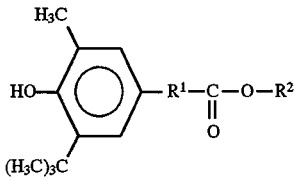

I where $R^1$ is an aklylene group of 1–6 carbon atoms and $R^2$ is an alkyl or alkenyl group of 1–24 carbon atoms.

The lubricating oil composition according to the invention finds wide application for lubrication of operating components and parts ranging from turbine, gasoline engine, diesel engine, automatic or manual transmission, differential or industrial gears, hydraulic drives, compressors, refrigerators, cutters, rolls, press, forging, squeezing, drawing, punching, thermal treatment, discharge or like metal processing, to sliding guides, bearings and other substrates to be lubricated.

The invention will be better understood from the following detailed description of certain embodiments.

DETAILED DESCRIPTION OF THE INVENTION

The component herein identified by (A) is a mineral oil having a kinematic viscosity at 40° C. of 5–200 $mm^2/s$ and an aromatics content of less than 15 percent by weight. Kinematic viscosities lower than 5 $mm^2/s$ would fail in lubricity due to deficient oil film formation, with increased evaporation losses when exposed to high temperature environment. With higher viscosities than 200 $mm^2/s$, the resulting oil composition would have increased flow resistance and hence increased friction resistance at the site of lubrication. Preferred kinematic viscosities therefore remain in the range of between 10 $mm^2/s$ and 100 $mm^2/s$. The aromatics content of the component (A) is preferably less than 10, more preferably less than 7 percent by weight. Departures from the specified aromatics content would fail to achieve the intended synergistic effect with the specified fatty acid ester upon prevention of oxidation and sludge formation, even if the dynamic viscosity is observed as specified. It has been found that the minimum aromatics content is 2% by weight or greater in order to ensure dissolution of sludge in the resultant lubricant composition.

The term aromatics content as used herein designates the content of aromatics fractions measured in accordance with ASTM D2549 (Standard Test Method for Separation of Representative Aromatics and Nonaromatics Fractions of High-Boiling Oils by Elution Chromatography). The aromatics fractions usually include alkylbenzene, alkylnaphthalene, anthracene, phenanthrene and alkylates thereof, tetra- or greater cyclic benzene condensates, and heteroaromatics such as pyridines, quinolines, phenols and naphthols.

The component (A) may be made available from (1) atmospheric distillation of paraffinic-base and/or mixed-base crude oil; (2) vacuum distillation (WVGO) of atmospheric distillates of paraffinic-base and/or mixed-base crude oil; (3) mild hydrocracking (HIX) of distillates (1) and (2); (4) mixtures of two or more of (1), (2) and (3); (5) deasphalted oil (DAO) of (1)–(4); (6) mild hydrocracking of oil (5); and (7) mixtures of two or more of (1)–(6). These starting oils may be refined to recover lubricant fractions for ready use or use after they are further purified. This refining or purifying process may be suitably carried out by hydrocracking or hydrorefining, solvent-extraction as with furfural, solvent or catalytic dewaxing, clay treatment such as with acid or active clay, and washing with sulfuric acid, caustic soda and the like. These different processes may be used in combination in the order and frequency desired. Needless to mention, other mineral oil mixtures may be equally used as the component (A) as long as they qualify the kinematic viscosity and aromatics content parameters specified herein.

In the case where the base oil for the inventive lubricating oil composition is selected solely from the component (A), the above exemplified starting oils (1)–(6) after treatment as above described is used in an amount of more than 50%, preferably more than 70%, more preferably more than 80% by weight of the total component (A).

The hydrocracking referred to above is carried out in the presence of a suitable catalyst usually at a total pressure of 60–250 kg/cm$^2$, a temperature of 350°–500° C. and an LHS of 0.1–2.0 hr.$^{-1}$ such that the cracking conversion exceeds 40% by weight. The catalyst may be chosen from molybdenum, chromium, tungsten, vanadium, platinum, nickel, copper, iron and cobalt and their oxides or sulfides which may be used singly or in combination and deposited if necessary on a suitable carrier such as silica-alumina, active alumina and zeolite.

The component (B) is an olefinic polymer having a carbon number of 2–16, preferably 2–12 which may be a homo- as well as co-polymer. This copolymer may be derived from random-, alternating- or block-polymerization of monomers such as alpha-olefins, inner olefins straight-chain or branched-chain olefins.

The olefins for the component (B) exemplarily include ethylene, propylene, 1-butene, 2-butene, isobutene, straight or branched pentene (including α-olefin and inner-olefin), straight or branched hexene (including α-olefin and inner-olefin), straight or branched heptene (including α-olefin and inner-olefin), straight or branched octene (including α-olefin and inner-olefin), straight or branched nonene (including α-olefin and inner-olefin), straight or branched decene (including α-olefin and inner-olefin), straight or branched undecene (including α-olefin and inner-olefin), straight or branched dodecene (including α-olefin and inner-olefin), straight or branched tridecene (including α-olefin and inner-olefin), straight or branched tetradecene (including α-olefin and inner-olefin), straight or branched pentadecene (including α-olefin and inner-olefin), straight or branched hexadecene (including α-olefin and inner-olefin) and mixture thereof, preferably ethylene, propylene, 1-butene, 2-butene, isobutene, 1-octene, 1-decene, 1-dodecene and mixture thereof.

The olefinic polymer (B) is derivable from homopolymerization or copolymerization of the above olefins by non-catalytic thermal reaction or in the presence of catalysts including organic peroxide catalyst such as benzoyl peroxide; Friedel-Crafts catalysts such as aluminum chloride, aluminum chloride-polyhydric alcohol, aluminum chloride-titanium tetrachloride, aluminum chloride-alkyltin halide and boron fluoride; Ziegler catalysts such as organoaluminum chloride-titanium tetrachloride and organoaluminum-titanium tetrachloride; metallocene catalysts such as aluminoxane-zirconocene and ionic compound-zirconocene; and Lewis acid-complex catalysts such as aluminum chloride-base and boron fluoride-base.

While the above exemplified olefinic polymers may be used per se, it is preferred for better results to use their hydrogenated products in consideration of thermal/oxidative stability. Such hydrogenated products may be obtained for example by catalytic hydrogenation to saturate the double-bonds of the polymers. An appropriate choice of catalysts can achieve the polymerization of olefins and the hydrogenation of their double-bonds both in a single step of process.

It has been found of particular interest in terms of thermal/oxidative stability, viscosity-temperature characteristics and low-temperature fluidity to use ethylene-propylene copolymers, copolymers derived from polymerization of polybutene fractions such butane-butene (mixtures of 1-butene, 2-butene and isobutene), 1-octene oligomers, 1-decene oligomers and 1-dodecene oligomers and hydrides and mixture thereof. Also eligible for use as the Component (B) are such commercially available ethylene-propylene copolymers, polybutenes and poly-alpha-olefins that have their double-bonds already hydrogenated, provided that their average molecular weights fall within the ranges hereinafter specified.

The number-average molecular weight range of the component (B) according to the invention has a lower limit value of 250, preferably 350 and a upper limit value of 4,000, preferably 1,500. Departures from the lower limit would result in poor lubricating performance of the oil composition due to insufficient oil film formation and in base oil losses by evaporation under elevated temperature conditions, and departures from the upper limit would lead to increased flow resistance, hence increased friction resistance at the lubrication areas.

The component (B) has, desirably though not necessarily, a kinematic viscosity of normally 5–200 mm$^2$/s, preferably 10–100 mm$^2$/s.

The component (C) according to the invention is one or more alkylbenzenes having 1–4 alkyl groups of 1–40, preferably 1–30, carbon atoms and a total carbon number of these alkyl groups in the range of 6–40, preferably 15–30. Lubricating oil compositions containing an alkylbenzene having less than 6 total carbon number of alkyl groups bonded to the benzene ring would fail in lubricity and would suffer base oil losses at elevated temperature, while those with greater than 40 total carbon number of alkyl groups bonded to the benzene ring would result in increased flow and friction resistance.

The alkyl groups in the component (C) include methyl group, ethyl group, propyl group, isopropyl group, n-butyl group, isobutyl group, sec-butyl group, tert-butyl group, straight or branched butyl group, straight or branched pentyl group, straight or branched hexyl group, straight or branched heptyl group, straight or branched octyl group, straight or branched nonyl group, straight or branched decyl group, straight or branched undecyl group, straight or branched dodecyl group, straight or branched tridecyl group, straight or branched tetradecyl group, straight or branched pentadecyl group, straight or branched hexadecyl group, straight or branched heptadecyl group, straight or branched octadecyl group, straight or branched nonadecyl group, straight or branched eicosyl group, straight or branched heneicosyl group, straight or branched docosyl group, straight or branched tricosyl group, straight or branched tetracosyl group, straight or branched pentacosyl group, straight or branched hexacosyl group, straight or branched heptacosyl group, straight or branched octacosyl group, straight or branched nonacosyl group, straight or branched triacontyl group, straight or branched hentriacontyl group, straight or branched dotriacontyl group, straight or branched tritriacontyl group, straight or branched tetracontyl group, straight or branched pentacontyl group, straight or branched hexacontyl group, straight or branched heptacontyl group, straight or branched octacontyl group, straight or branched nonacontyl group and straight or branched hectyl group.

With viscosity-temperature characteristics and low-temperature fluidity taken into account as desired for the inventive lubricant composition, the alkyl groups are more preferably of branched-chain than straight-chain and such preferred branched-chain alkyl groups include olefinic oligomer derivatives such as propylene, 1-butene and isobutylene that are readily commercially available.

From the viewpoint of good thermal/oxidative stability and easy commercial access, the most preferred component (C) is a monoalkylbenzene and a dialkylbenzene or mixtures thereof.

The component (C) has a kinematic viscosity in the range of 5–200 mm$^2$/s, preferably 10–100 mm$^2$/s.

The component (C) alkylbenzenes may be produced typically by catalytically alkylating aromatic compounds such as benzene, toluene, xylene, ethylbenzene, methylbenzene, diethylbenzene and mixtures thereof. The alkylating agent includes lower monoolefins such as ethylene propylene, butene and isobutene, preferably straight or branched $C_6$–$C_{40}$ olefins resulting from propylene polymerization; straight or branched $C_6$–$C_{40}$ olefins available available from the thermal cracking of wax, heavy oil, petroleum fractions, polyethylene and polypropylene; and straight or branched $C_6$–$C_{40}$ olefins derived from separating and catalytically dehydrogenating n-paraffins from kerosene, gas oil and other petroleum fractions.

The alkylation catalyst includes a Friedel-Crafts catalyst such as aluminum chloride and zinc chloride, and an acidic catalyst such as sulfuric acid, phosphoric acid, silicotungstenic acid, hydrofluoric acid and active clay.

The 3-methyl-5-tert-butyl-4-hydroxyphenyl-substituted fatty acid ester used in the invention is represented by the formula

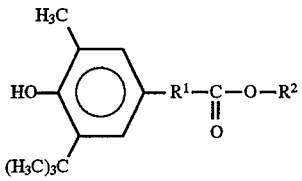

I where $R^1$ is an alkylene group of 1–6 carbon atoms and $R^2$ is an alkyl or alkenyl group of 1–24 carbon atoms.

The $C_1$–$C_6$ alkylene group $R^1$ may be of straight or branched chain, exemplarily including methylene group, ethylene group, propylene group (1-methylethylene group, 2-methylethylene group), trimethylene group, butylene group (1-ethylethylene group, 2-ethylethylene group), 1,2-dimethylethylene group, 2,2-dimethylethylene group, 1-methyltrimethylene group, 2-methyltrimethylene group, 3-methyltrimethylene group, tetramethylene group, pentylene group (1-butylethylene group, 2-butylethylene group), 1-ethyl-1-methylethylene group, 1-ethyl-2-methylethylene group, 1,1,2-trimethylethylene group, 1,2,2-trimethylethylene group, 1-ethyltrimethylene group, 2-ethyltrimethylene group, 3-ethyltrimethylene group, 1,1-dimethyltrimethylene group, 1,2-dimethyltrimethylene group, 1,3-dimethyltrimethylene group, 2,3-dimethyltrimethylene group, 3,3-dimethyltrimethylene group, 1-methyltetramethylene group, 2-methyltetramethylene group, 3-methyltetramethylene group, 4-methyltetramethylene group, pentamethylene group, hexylene group (1-butylethylene group, 2-butylethylene group), 1-methyl-1-propylethylene group, 1-methyl-2-propylethylene group, 2-methyl-2-propylethylene group, 1,1-diethylethylene group, 1,2-diethylethylene group, 2,2-diethylethylene group, 1-ethyl-1,2-dimethylethylene group, 1-ethyl-2,2-dimethylethylene group, 2-ethyl-1,1-dimethylethylene group, 2-ethyl-1,2-dimethylethylene group, 1,1,2,2-tetramethylethylene group, 1-propyltrimethylene group, 2-propyltrimethylene group, 3-propyltrimethylene group, 1-ethyl-1-methyltrimethylene group, 1-ethyl-2-methyltrimethylene group, 1-ethyl-3-methyltrimethylene group, 2-ethyl-1-methyltrimethylene group, 2-ethyl-2-methyltrimethylene group, 2-ethyl-3-methyltrimethylene group, 3-ethyl-1-methyltrimethylene group, 3-ethyl-2-methyltrimethylene group, 3-ethyl-3-methyltrimethylene group, 1,1,2-trimethyltrimethylene group, 1,1,3-trimethyltrimethylene group, 1,2,2-trimethyltrimethylene group, 1,2,3-trimethyltrimethylene group, 1,3,3-trimethyltrimethylene group, 2,2,3-trimethyltrimethylene group, 2,3,3-trimethyltrimethylene group, 1-ethyltetramethylene group, 2-ethyltetramethylene group, 3-ethyltetramethylene group, 4-ethyltetramethylene group, 1,1-dimethyltetramethylene group, 1,2-dimethyltetramethylene group, 1,3-dimethyltetramethylene group, 1,4-dimethyltetramethylene group, 2,2-dimethyltetramethylene group, 2,3-dimethyltetramethylene group, 2,4-dimethyltetramethylene group, 3,3-dimethyltetramethylene group, 3,4-dimethyltetramethylene group, 4,4-dimethyltetramethylene group, 1-methylpentamethylene group, 2-methylpentamethylene group, 3-methylpentamethylene group, 4-methylpentamethylene group, 5-methylpentamethylene group and hexamethylene group. Most preferred are $C_1$–$C_2$ alkylene groups such as methylene or ethylene groups that may be made available with a minimum of reaction process steps.

The $C_1$–$C_{24}$ alkyl or alkenyl groups $R^2$ may be of straight or branched chain: alkyl group exemplarily including methyl group, ethy group, n-propyl group, isopropyl group, n-butyl group, isobutyl group, sec-butyl group, tert-butyl group, straight or branched pentyl group, straight or branched hexyl group, straight or branched heptyl group, straight or branched octyl group, straight or branched nonyl group, straight or branched decyl group, straight or branched undecyl group, straight or branched dodecyl group, straight or branched tridecyl group, straight or branched tetradecyl group, straight or branched pentadecyl group, straight or branched hexadecyl group, straight or branched heptadecyl group, straight or branched octadecyl group, straight or branched nonadecyl group, straight or branched eicosyl group, straight or branched heneicosyl group, straight or branched docosyl group, straight or branched tricosyl group, and straight or branched tetracosyl group; and alkenyl group exemplarily including vinyl group, propenyl group, isopropenyl group, straight or branched butenyl group, straight or branched pentenyl group, straight or branched hexenyl group, straight or branched heptenyl group, straight or branched octenyl group, straight or branched nonenyl group, straight or branched decenyl group, straight or branched undecenyl group, straight or branched dodecenyl group, straight or branched tridecenyl group, straight or branched tetradecenyl group, straight or branched pentadecenyl group, straight or branched hexadecenyl group, straight or branched heptadecenyl group, straight or branched octadecenyl group, straight or branched nonadecenyl group, straight or branched eicosenyl group, straight or branched heneicosenyl group, straight or branched docosenyl group, straight or branched tricosenyl group and straight or branched tetracosenyl group.

Preferred examples from the viewpoint of compatibility with the compounds (A), (B) and (C) of formula I include $C_4$–$C_{18}$ alkyl groups such as n-butyl group, isobutyl group, sec-butyl group, tert-butyl group, straight or branched pentyl group, straight or branched hexyl group, straight or branched heptyl group, straight or branched octyl group, straight or branched nonyl group, straight or branched decyl group, straight or branched undecyl group, straight or branched dodecyl group, straight or branched tridecyl group, straight or branched tetradecyl group, straight or branched pentadecyl group, straight or branched hexadecyl group, straight or branched heptadecyl group and straight or branched octadecyl group, preferably $C_6$–$C_{12}$ straight or branched alkyl groups, and more preferably $C_6$–$C_{12}$ branched alkyl groups.

It has been thus found that amongst the above numerous fatty acid esters, the most preferred ones are $R^1$=$C_1$–$C_2$ alkylene groups and $R^2$=$C_6$–$C_{12}$ branched alkyl groups.

Specific examples of the fatty acid ester of formula I include (3-methyl-5-tert-butyl-4-hydroxyphenyl) n-hexyl acetate, (3-methyl-5-tert-butyl-4-hydroxyphenyl) isohexyl acetate, (3-methyl-5-tert-butyl-4-hydroxyphenyl) n-heptyl acetate, (3-methyl-5-tert-butyl-4-hydroxyphenyl) isoheptyl acetate, (3-methyl-5-tert-butyl-4-hydroxyphenyl) n-octyl acetate, (3-methyl-5-tert-butyl-4-hydroxyphenyl) isooctyl acetate, (3-methyl-5-tert-butyl-4-hydroxyphenyl) 2-ethyl hexyl acetate, (3-methyl-5-tert-butyl-4-hydroxyphenyl) n-nonyl acetate, (3-methyl-5-tert-butyl-4-hydroxyphenyl) isononyl acetate, (3-methyl-5-tert-butyl-4-hydroxyphenyl) n-decyl acetate, (3-methyl-5-tert-butyl-4-hydroxyphenyl) isodecyl acetate, (3-methyl-5-tert-butyl-4-hydroxyphenyl) n-undecyl acetate, (3-methyl-5-tert-butyl-4-hydroxyphenyl) isoundecyl acetate, (3-methyl-5-tert-butyl-4-hydroxyphenyl) n-dodecyl acetate, (3-methyl-5-tert-butyl-4-hydroxyphenyl) isododecyl acetate, (3-methyl-5-tert-butyl-4-hydroxyphenyl) n-hexyl propionate, (3-methyl-5-tert-butyl-4-hydroxyphenyl) isohexyl propionate, (3-methyl-5-tert-butyl-4-hydroxyphenyl) n-heptyl propionate, (3-methyl-5-tert-butyl-4-hydroxyphenyl) isoheptyl propionate, (3-methyl-5-tert-butyl-4-hydroxyphenyl) n-octyl propionate, (3-methyl-5-tert-butyl-4-hydroxyphenyl) isooctyl propionate, (3-methyl-5-tert-butyl-4-hydroxyphenyl) 2-ethylhexyl propionate, (3-methyl-5-tert-butyl-4-hydroxyphenyl) n-nonyl propionate, (3-methyl-5-tert-butyl-4-hydroxyphenyl) isononyl propionate, (3-methyl-5-tert-butyl-4-hydroxyphenyl) n-decyl propionate, (3-methyl-5-tert-butyl-4-hydroxyphenyl) isodecyl propionate, (3-methyl-5-tert-butyl-4-hydroxyphenyl) n-undecyl propionate, (3-methyl-5-tert-butyl-4-hydroxyphenyl) isoundecyl propionate, (3-methyl-5-tert-butyl-4-hydroxyphenyl) n-dodecyl propionate and (3-methyl-5-tert-butyl-4-hydroxyphenyl) isododecyl propionate. These esters may be also used in combination.

The 3-methyl-5-tert-butyl-4-hydroxyphenyl-substituted fatty acid ester used in the invention may be prepared by any known processes, for instance by reacting a 2-methyl-6-tert-butylphenol with methylacrylate in the presence of a basic catalyst such as metallic sodium to produce (3-methyl-5-tert-butyl-4-hydroxyphenyl)methyl propionate. This propionate may be subjected to ester-exchange reaction with a $C_2$–$C_{24}$ aliphatic alcohol to obtain an esterified compound. The content of the 3-methyl-5-tert-butyl-4-hydroxyphenyl-substituted fatty acid ester in the inventive lubricant composition is in the range of between 0.1, preferably 0.2 and 5.0, preferably 3.0 percent by weight. Contents less than the lower limit of the specified range would result in reduced oxidative-stability and if in excess of the upper limit would not give so much oxidative-stability, merely leading to economically infeasible usage.

For the purpose of providing enhanced oxidative-stability and improved sludge prevention, the inventive lubricating oil composition may be blended with one or more suitable additives including antioxidants such as of phenols, amines, sulfurs, zinc dithiophosphates and phenothiazines; rust inhibitors such as alkenyl succinic acid, alkenyl succinate, polyhydric alcohol ester, petroleum sulfonic acid and dinonylnaphthalenesulfonate; wear inhibitors and extreme pressure additives such as phosphoric ester, sulfurized fat and oil, sulfide and zinc dithiophosphate; wear-reducing agents such as aliphatic alcohol, fatty acid, aliphatic amine, aliphatic amine salt and fatty acid amide; metallic detergents such as alkaline-earth metal sulfonate, alkaline-earth metal phenolate, alkaline-earth metal salicylate and alkaline-earth metal phosphonate; non-ash dispersants such as alkenyl succinimide, alkenyl succinate and benzylamine; antifoaming agents such as methylsilicone and fluorosilicone; and viscosity index improvers or pour point depressants such as polymethacrylate, polyisobutylene, olefin copolymer and polystyrene. Deforming agents may be added in an amount of 0.0005–1 weight %; viscosity index improvers in an amount of 1–30 weight %; metallic inactivators in an amount of 0.005–1 weight %; and other additives in an amount of 0.1–15 weight %, all based on the total composition.

In the case where the base oil is selected from either the component (B) or the component (C) alone or mixtures thereof in the absence of the component (A), there may be used certain mineral oil-based oil, ester-based oil, ether-based oil or mixtures thereof each of which has a kinematic viscosity of 5–200 $mm^2/s$, preferably 10–100 $mm^2/s$ and may be used in a total amount of 30, preferably 20 weight % based on the total composition, particularly for application for example to rubber sealants with bulging held to a minimum.

The mineral oil-based oil referred to above may be made available from atmospheric or vacuum distillation fractions of paraffinic or naphthenic crude oil which distillation fractions are refined by hydrogenation, solvent-extraction, dewaxing, clay or chemicals (acid/alkali) treatment singly or in combination, or in any order and frequency desired. Such refined fractions may be used regardless of their total aromatics contents. It has now been found however that mineral oils specified as the component (A) are superior to any of the aforesaid oil fractions in respect of the synergistic effect with the specified fatty acid ester upon prevention of oxidation and sludge formation as contemplated under the invention.

The ester-based oil referred to above includes diester oil such as ditridecyl glutarate, di-2-ethylhexyl adipate, diisodecyl adipate, ditridecyl adipate and di-3-ethylhexyl sebacate, polyol ester oil such as trimethylolpropane tricaprylate, trimethylolpropane tripelargonate, pentaerythritoltetra(2-ethyl hexanate), and pentaerythritoltetrapelargonate and mixtures thereof.

The ether-based oil includes: polyglycol oils such as polyoxyethylene glycol, polyoxypropylene glycol, polyoxyethyleneoxypropylene glycol and polyoxybutylene glycol; monoalkyl ether, dialkyl ether, diphenyl ether and polyphenylene ether; and mixtures thereof.

EXAMPLES

Various lubricating oil compositions listed as Inventive Examples 1–9 and Comparative Examples 1–14 in Table 1 were prepared from the following formulations.

Base oil (A): Hydrocracked paraffinic mineral oil (kinematic viscosity at 40° C. 32 $mm^2/s$, aromatics content 5 weight %)

(B): Hydrogenated 1-decene oligomer (number-average molecular weight 480, kinematic viscosity at 40° C. 31 $mm^2/s$)

(C): monoalkylbenzene mixtures having one $C_{12}$–$C_{18}$ alkyl group (kinematic viscosity at 40° C. 32 $mm^2/s$)

(D): Solvent refined paraffinic mineral oil (kinematic viscosity at 40° 32 $mm^2/s$, aromatics content 25 weight %)

3-methyl-5-tert-butyl-4-hydroxyphenyl-substituted Fatty Acid Ester (E): 3-methyl-5-tert-butyl-4-hydroxy propionic acid ester of the formula

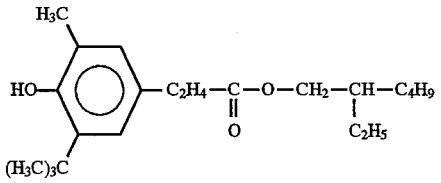

II (F): 3-methyl-5-tert-butyl-4-hydroxy acetic acid ester of the formula

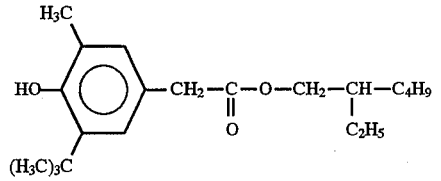

III

Oxidation Inhibitor (G): 2,6-di-tert-butyl-p-cresol of the formula

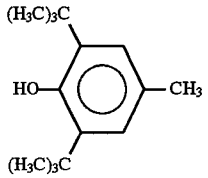

IV (H): (3,5-di-tert-butyl-4-hydroxyphenyl)propionic acid ester of the formula

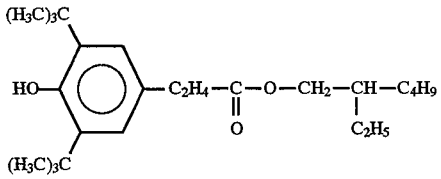

V

TABLE 1

| | Formulation | | | |
|---|---|---|---|---|
| | | Additive | | |
| | Base Oil | Type | Content (wt % based on total composition) | Oxidative stability test (min.)*1 |
| Inventive Examples | | | | |
| 1 | A | E | 1.0 | 595 |
| 2 | A | E | 2.0 | 640 |
| 3 | B | E | 1.0 | 660 |
| 4 | C | E | 1.0 | 580 |
| 5 | B(50) + C(50)*2 | E | 1.0 | 620 |
| 6 | A | F | 1.0 | 730 |
| 7 | B | F | 1.0 | 790 |
| 8 | C | F | 1.0 | 670 |
| 9 | A(50) + B(50)*2 | F | 1.0 | 725 |
| Comparative Examples | | | | |
| 1 | A | — | — | 25 |
| 2 | B | — | — | 20 |
| 3 | C | — | — | 35 |
| 4 | D | — | — | 50 |
| 5 | D | E | 1.0 | 203 |
| 6 | D | F | 1.0 | 195 |
| 7 | D | G | 1.0 | 185 |

TABLE 1-continued

| | Formulation | | | |
|---|---|---|---|---|
| | | Additive | | |
| | Base Oil | Type | Content (wt % based on total composition) | Oxidative stability test (min.)*1 |
| 8 | D | H | 1.0 | 160 |
| 9 | A | G | 1.0 | 400 |
| 10 | A | H | 1.0 | 220 |
| 11 | B | G | 1.0 | 480 |
| 12 | B | H | 1.0 | 250 |
| 13 | C | G | 1.0 | 380 |
| 14 | C | H | 1.0 | 195 |

Note:
*1conducted in accordance with JIS K2514 3.3 to measure time length from initiation to termination.
*2denotes contents by weight % based on total composition.

It is believed attributable to the synergistic effect arising out of the combination of the particular base oil and the particular fatty acid ester selected by the invention that the resultant lubricating oil compositions exhibit increased anti-oxidative and sludge-free properties and advantages over the conventional comparative counterparts. Even though base oil (D) may excel base oils (A), (B) and (C) per se in oxidative stability, it is still inferior when compared with the inventive composition in which the latter base oils are used in combination with the fatty acid ester additives (E) or (F), as demonstrated in Table 1.

What is claimed is:

1. A lubricating oil composition which comprises one or more base oils of the group consisting of (A) a mineral oil having a kinematic viscosity of 5–200 $m^2/s$ at 40° C. and an aromatics content of less than 15 percent by weight, (B) an olefinic polymer of 2–16 carbon atoms having a number-average molecular weight of 250–4,000, and (C) an alkylbenzene having 1–4 alkyl groups of 1–40 carbon atoms and a total carbon number of said alkyl groups in the range of 6–40, said base oil or oils being blended with a 3-methyl-5-tert-butyl-4-hydroxyphenyl-substituted fatty acid ester in an amount of 0.1–5.0 percent by weight based on total composition, said fatty acid ester being represented by the formula

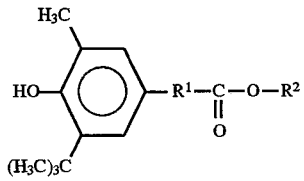

I where $R^1$ is an aklylene group of 1–6 carbon atoms and $R^2$ is an alkyl or alkenyl group of 1–24 carbon atoms.

2. A lubricating oil composition according to claim 1 in which said aromatics content is greater than 2 percent by weight.

3. A lubricating oil composition according to claim 1 in which said olefinic polymer (B) has its double-bonds catalytically hydrogenated.

4. A lubricating oil composition according to claim 3 in which said olefinic polymer (B) is selected from the group consisting of hydrogenated ethylene-propylene copolymer, hydrogenated polybutene, hydrogenated 1-octene oligomer, hydrogenated 1-decene oligomer, hydrogenated 1-dodecene oligomer and mixture thereof.

5. A lubricating oil composition according to claim 1 wherein said alkylbenzene is selected from the group consisting of monoalkylbenzene and dialkylbenzene.

6. A lubricating oil composition according to claim 1 wherein said fatty acid ester has an alkylene group $R^1$ of 1–2 carbon atoms and a branched chain alkyl group $R^2$ of 6–12 carbon atoms.

7. A lubricating oil composition according to claim 1 wherein $R^1$ in formula (I) is an alkylene group of 1–2 carbon atoms.

8. A lubricating oil composition according to claim 1 wherein $R^2$ in formula (I) is an alkyl group of 4–18 carbon atoms.

9. A lubricating oil composition according to claim 1 wherein $R^2$ in formula (I) is a straight or branched chain alkyl group of 6–12 carbon atoms.

10. A lubricating oil composition according to claim 1 wherein $R^2$ in formula (I) is a branched alkyl group of 6–12 carbon atoms.

* * * * *